US011808116B2

(12) United States Patent
MacGillivray et al.

(10) Patent No.: US 11,808,116 B2
(45) Date of Patent: Nov. 7, 2023

(54) CONNECTOR FOR PERFORATING GUN SYSTEM

(71) Applicant: Halliburton Energy Services, Inc., Houston, TX (US)

(72) Inventors: Joseph Todd MacGillivray, Fort Worth, TX (US); Courtney Ann Thain Roberts, Crowley, TX (US); Camille Anne Bryant, Cleburne, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 156 days.

(21) Appl. No.: 17/306,649

(22) Filed: May 3, 2021

(65) Prior Publication Data

US 2021/0396103 A1 Dec. 23, 2021

Related U.S. Application Data

(60) Provisional application No. 63/042,922, filed on Jun. 23, 2020.

(51) Int. Cl.
*E21B 43/1185* (2006.01)
*E21B 43/119* (2006.01)
*E21B 43/117* (2006.01)

(52) U.S. Cl.
CPC ..... *E21B 43/11855* (2013.01); *E21B 43/117* (2013.01); *E21B 43/119* (2013.01)

(58) Field of Classification Search
CPC .. E21B 43/1185; E21B 43/117; E21B 43/119; E21B 43/116; E21B 17/028
See application file for complete search history.

(56) References Cited

U.S. PATENT DOCUMENTS

| | | | |
|---|---|---|---|
| 4,703,986 | A | 11/1987 | McCormick |
| 5,145,409 | A | 9/1992 | Sato et al. |
| 9,184,529 | B2 | 11/2015 | Ulrich et al. |
| 9,490,596 | B1 | 11/2016 | Yu et al. |
| 9,581,422 | B2 | 2/2017 | Preiss et al. |

(Continued)

FOREIGN PATENT DOCUMENTS

| | | | |
|---|---|---|---|
| CA | 2933756 | A1 | 11/2015 |
| CN | 208932696 | | 6/2019 |
| WO | 2020094447 | A1 | 5/2020 |

OTHER PUBLICATIONS

Core Laboratories, Owen Oil Tools—Zero180 product line, 2021. Available at https://www.corelab.com/owen/gunsystems-zero180.
Halliburton, Velocity™ Perforating System, H012844WP, Jul. 2019.

*Primary Examiner* — Zakiya W Bates
(74) *Attorney, Agent, or Firm* — John Wustenberg; C. Tumey Law Group PLLC

(57) ABSTRACT

A perforating gun connection whereby a signal may be carried from surface, down through a wireline or other conveyance, and across the connection from the pin on one perforating gun to an electrical contact structure on the next perforating gun in the string. In an example, the connection includes a connector body with an electrical pin positioned for contact with an electrical contact structure on the next perforating gun. The electrical contact structure has a contact tab aligned for engagement by the pin when connected with the connector body. The electrical contact structure may be unitarily formed to include a number of features to facilitate connection between perforating guns.

20 Claims, 5 Drawing Sheets

(56) References Cited

U.S. PATENT DOCUMENTS

| | | | |
|---|---|---|---|
| 9,689,223 | B2 | 6/2017 | Schacherer et al. |
| 9,831,568 | B2 | 11/2017 | Giefers |
| 2007/0062702 | A1 | 3/2007 | Walters et al. |
| 2007/0062703 | A1 | 3/2007 | Walters et al. |
| 2007/0256836 | A1 | 11/2007 | Welton et al. |
| 2008/0035338 | A1 | 2/2008 | Pauls et al. |
| 2008/0035339 | A1 | 2/2008 | Welton et al. |
| 2008/0035340 | A1 | 2/2008 | Welton et al. |
| 2008/0078546 | A1 | 4/2008 | Welton et al. |
| 2008/0128131 | A1 | 6/2008 | Nguyen et al. |
| 2008/0161207 | A1 | 7/2008 | Welton et al. |
| 2008/0161210 | A1 | 7/2008 | Welton et al. |
| 2008/0161212 | A1 | 7/2008 | Welton et al. |
| 2009/0298721 | A1 | 12/2009 | Robb et al. |
| 2009/0305913 | A1 | 12/2009 | Welton et al. |
| 2010/0004890 | A1 | 1/2010 | Tonmukayakul et al. |
| 2010/0018294 | A1 | 1/2010 | Tonmukayakul et al. |
| 2010/0041283 | A1 | 2/2010 | Hernandez et al. |
| 2010/0276151 | A1 | 11/2010 | Pauls et al. |
| 2011/0155376 | A1 | 6/2011 | Robb et al. |
| 2012/0018148 | A1 | 1/2012 | Bryant et al. |
| 2012/0270758 | A1 | 10/2012 | Saini et al. |
| 2013/0043074 | A1 | 2/2013 | Tassaroli |
| 2013/0233697 | A1 | 9/2013 | Bryant |
| 2013/0346035 | A1 | 12/2013 | Madasu et al. |
| 2014/0144633 | A1 | 5/2014 | Nguyen et al. |
| 2014/0144635 | A1 | 5/2014 | Nguyen et al. |
| 2014/0335714 | A1 | 11/2014 | Schrader |
| 2015/0186562 | A1 | 7/2015 | Johnson et al. |
| 2018/0119529 | A1 | 5/2018 | Goyeneche |
| 2020/0277843 | A1 | 9/2020 | MacGillivray et al. |
| 2021/0054724 | A1 | 2/2021 | Robey et al. |
| 2021/0172298 | A1* | 6/2021 | Knight ..... E21B 43/1185 |
| 2021/0223007 | A1* | 7/2021 | Kash ..... F42B 3/103 |
| 2021/0230986 | A1* | 7/2021 | Macgillivray ..... H05K 1/0216 |

* cited by examiner

CONNECTOR FOR PERFORATING GUN SYSTEM

CROSS-REFERENCE TO RELATED APPLICATIONS

This is a nonprovisional application claiming priority to U.S. Provisional Patent Application No. 63/042,922, filed Jun. 23, 2020, the entirety of which is incorporated herein by reference.

BACKGROUND

After drilling a subterranean wellbore that traverses a hydrocarbon-bearing formation, individual lengths of relatively large diameter metal tubulars, referred to as casing, are typically secured together to form a casing string within the wellbore. This casing string increases the integrity of the wellbore and provides a centralized path for producing fluids extracted from intervals in the formation to the surface. Conventionally, the casing string is cemented within the wellbore. To facilitate the production of fluids from the formation, the casing string may be perforated to form perforations comprising hydraulic openings extending into the surrounding subterranean formation.

Typically, perforations are created by positioning a perforating gun string downhole and detonating a series of explosive shaped charges adjacent to the formation to be produced. Specifically, one or more perforating guns are loaded with shaped charges, that may be coupled with connectors to form a perforating gun string. For safety, perforating guns may be transported to a wellsite in a partially unassembled configuration, such as without having an electrical detonator coupled to a detonating cord. Once assembled, a perforating gun string may be lowered into the cased wellbore on an appropriate conveyance, such as a wireline. After the perforating gun string is in the desired wellbore position, a firing head may be selectively actuated to detonate the shaped charges in a predetermined fashion, thereby creating the perforations in the casing string. The perforating gun string may then be retrieved to the surface.

BRIEF DESCRIPTION OF THE DRAWINGS

These drawings illustrate certain aspects of some of the embodiments of the present disclosure and should not be used to limit or define the method.

DETAILED DESCRIPTION

The embodiments described herein relate to perforating gun connections and, more particularly, to connections that allows perforating guns to be electrically connected automatically in response to mechanically coupling adjacent perforating guns. This promotes safety, reliability, and simplifies assembly.

In at least one example, an apparatus is disclosed for connecting adjacent perforating guns. The terms "first" and "second" are used to distinguish one gun from the other, and do not necessarily imply a sequence of connection or firing. One perforating gun may be the initial perforating gun in a string or the perforating gun previously added to the perforating gun string, and the other perforating gun may be a next perforating gun to be connected to the perforating gun string. A connector body, which may comprise a bulkhead, may be connected to one perforating gun prior to connecting the other perforating gun. The connector body may carry a pin which is positioned for contacting an electrical contact structure on one of the perforating guns when the connector body is connected to the other perforating gun. The pin may also be electrically coupled in advance to the perforating gun to be connected, such as by hardwiring or via a contact plate on a detonator in that perforating gun, to establish signal communication between the two perforating guns.

The electrical contact structure may have multiple functional elements optionally formed from a single specimen of an electrically conductive material. These elements may include a metal contact tab with a large surface for automatically electrically contacting a corresponding electrical structure (e.g., a pin) of the next perforating gun in the string in the process of mechanically coupling the two adjacent perforating guns. The flexibility and shape of the contact tab is such that it may not require a specific mating contact part, so long as the parts touch with sufficient force to provide a constant electrical connection. The electrical contact structure may further include a spring element adjacent the contact tab, which elastically deflects upon engagement of the pin with the contact tab, to bias the contact tab into reliable, continuous electrical contact with the pin. This ensures that the tab will return to its original position for multiple assembly and disassembly cycles of the perforating gun string. The electrical contact structure may further include a fastening element for electrically coupling to one or more wires within a circuit path. Certain alignment features may also be built into the electrical contact structure to precisely align it within the perforating gun system. These and further elements and combinations thereof are discussed in the example embodiments that follow.

Figure 1:
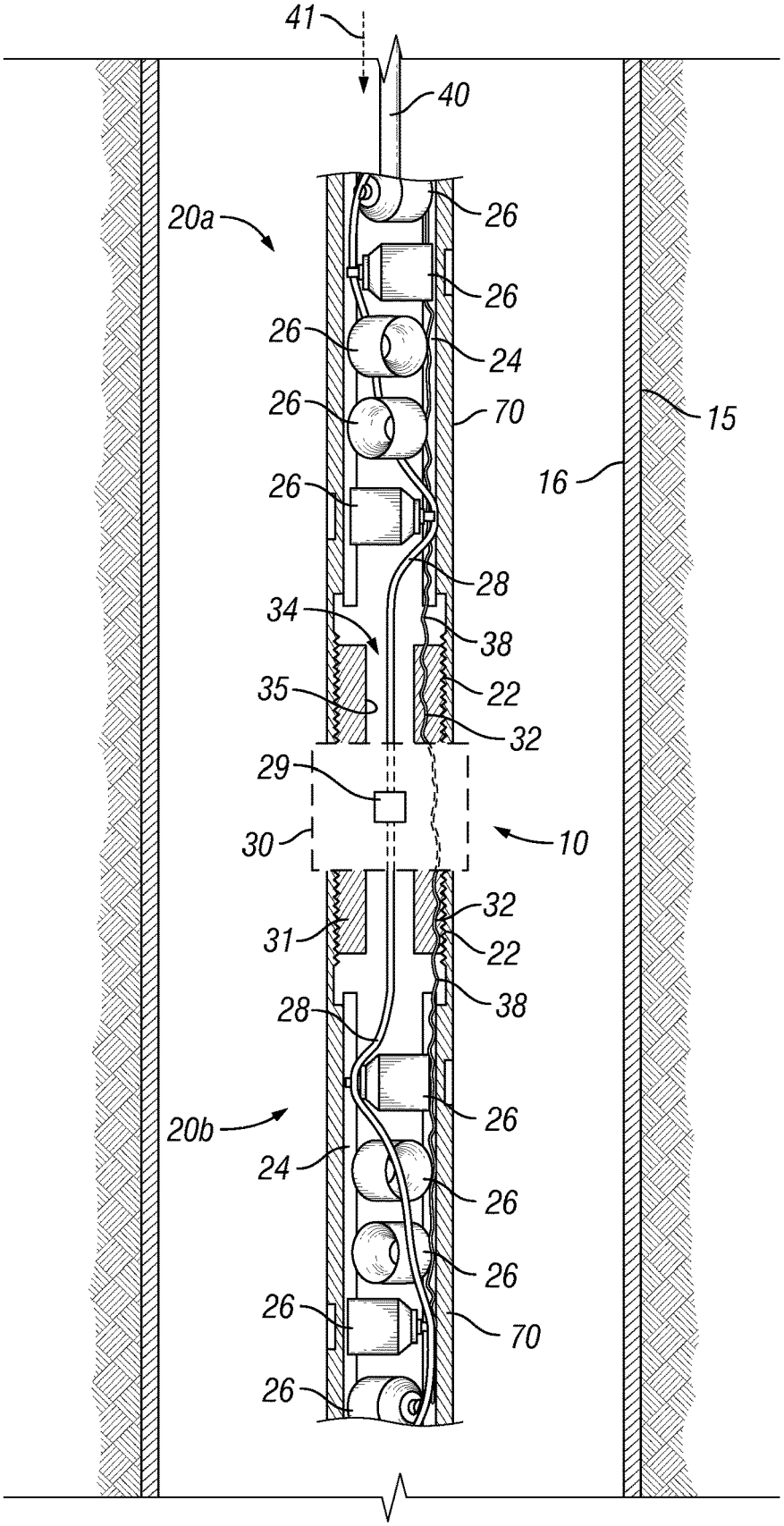
FIG. 1 is a cross-sectional view of an example perforating gun string having at least two perforating guns coupled end to end.

FIG. 1 is a cross-sectional view of a perforating gun string 10 lowered on a wireline 40 into a wellbore 15 lined with casing 16 to be perforated. The perforating gun string 10 is assembled above ground, either at the well site or at a remote location and transported to the well site. The perforating gun string 10 may be assembled from any number of perforating guns connected end to end, of which two adjacent perforating guns 20*a*, 20*b* are shown in FIG. 1. The two perforating guns 20*a*, 20*b* may be referred to as the first and second perforating guns 20, 20*b*, respectively. However, the terms first and second are not intended to be limiting as to an order in which the perforating guns are connected and/or fired, which may vary depending on the embodiment. Each perforating gun has a rigid perforating gun body 70 to house and protect the internal components ("internals") of the perforating gun and for structurally connecting at either end with adjacent perforating gun bodies in the perforating gun string 10. The adjacent perforating guns 20*a*, 20*b* are connected with a connection schematically indicated at 30 that may be provided between every pair of adjacent perforating guns in the perforating gun string 10. The connection 30 may both physically connect adjacent perforating guns to form the perforating gun string 10 and electrically connect the adjacent perforating guns to establishing electronic communication along the perforating gun string 10. The connection 30 and some specific example configurations of the connection 30 are further discussed below.

Each perforating gun 20*a*, 20*b* includes a plurality of shaped charges disposed within the perforating gun body 70 that are configured, when detonated, to focus the effect of their explosive energy in a particular direction. A structural charge holder is provided internal to the perforating gun bodies 70 for holding the shaped charges 26 in selected firing orientations, which may be radially toward the casing 16 and at different azimuthal directions with respect to one another. The charge holder in this example is a unitary charge tube 24 for holding multiple shaped charges 26 at predetermined firing orientations. An alternative structure may instead comprise individual charge holders that snap together to form a structure to individually orient each shaped charge in the desired firing orientation.

The string of shaped charges 26 may be electrically connected inside the perforating gun bodies 70 with a common detonation cord 28 used to explosively detonate the shaped charges 26 in response to a detonation signal. The detonation cord 28 is connected to a firing module or detonator 29 housed in each perforating gun body 70. The detonator 29 may energize the detonation cord 28 to detonate the explosive charges within the respective perforating gun body 70 upon receiving a detonation signal. A separate signal conductor 38 is routed through each perforating gun body 70. The signal conductors may comprise, for example, a flexible wire, an electric trace, or a ribbon, that is routed along each perforating gun body 70 to a signal input on each detonator 29 and to the connection 30. The signal conductors 38 are interconnected via the connection 30 between each pair of adjacent perforating guns to form a continuous signal path for communicating electrical signals from the wireline 40, along the perforating gun string, and to each detonator 29. The location of the schematically shown detonator 29, and the routing of the detonator cord 28 and signal conductors 38 within each perforating gun body 70, are illustrated by way of example and may vary according to the design of the perforating gun selected. Any of a variety of different perforating gun configurations may be configured for use with the connection 30 according to this disclosure, regardless of the internal routing of the signal conductor within each perforating gun body 70.

The connection 30 may include both electrical features and mechanical features. Certain mechanical features, such as threaded connections between perforating gun bodies, may provide a robust structural connection between adjacent perforating guns when assembling the string 10. Certain mechanical features may also help align, guide, and maintain contact between corresponding electrical features on adjacent perforating guns. Each perforating gun 20*a*, 20*b* in this example includes a threaded female connection 22 on the respective perforating gun body 70 that may be threadedly coupled to male connections 32 on opposing ends of a connector sub 31. An alternative example may have an internally threaded end of one perforating gun body for directly coupling to an externally threaded end of the adjacent perforating gun body, without a connector sub therebetween. However, any other suitable connection for physically coupling the adjacent perforating gun bodies 70 is considered within the scope of this disclosure. When the mechanical connection is made at the connection 30, an electronic connection is also made that places the signal conductors 38 of adjacent perforating guns 20*a*, 20*b* in electronic communication. This connection between each pair of adjacent perforating guns thereby completes a continuous electronic signal path from the wireline 40, along the signal conductor 38 of each perforating gun and across the respective connection 30 between perforating guns, to allow communication of a signal 41 from the wireline 40 to any of the perforating guns in the perforating gun string 10.

To perform a perforating operation, the perforating gun string 10 is lowered into the wellbore 15 on the wireline 40 and suspended within a section of casing 16 to be perforated. The perforating gun string could alternatively be conveyed on a tubing string or coiled tubing in other examples. The wireline 40 or other conveyance (e.g., tubing string or coiled tubing) communicates the signal 41 through the perforating gun string 10 along the continuous signal pathway formed by the signal conductors 38 across the connection(s) 30. For example, the wireline 40 may communicate a signal 41 generated from a controller at the surface of the well site addressing selected perforating guns in the string 10 to be fired when performing a perforating operation.

The signal 41 may be routed along the individual signal conductors 38 to the firing module or detonator 29 of the respective perforating gun. Each perforating gun 20*a*, 20*b* may be individually addressable, such as using a selective firing module or detonator. For example, the detonator 29 in each perforating gun 20*a*, 20*b* may have a unique IP address, so that the signal 41 may address selected perforating guns to cause firing of the shaped charges 26 within the respective perforating gun body 70. Thus, all of the perforating guns or a selected subset of the perforating guns could respond to the same signal 41 to simultaneously fire the associated explosive charges.

Figure 2:
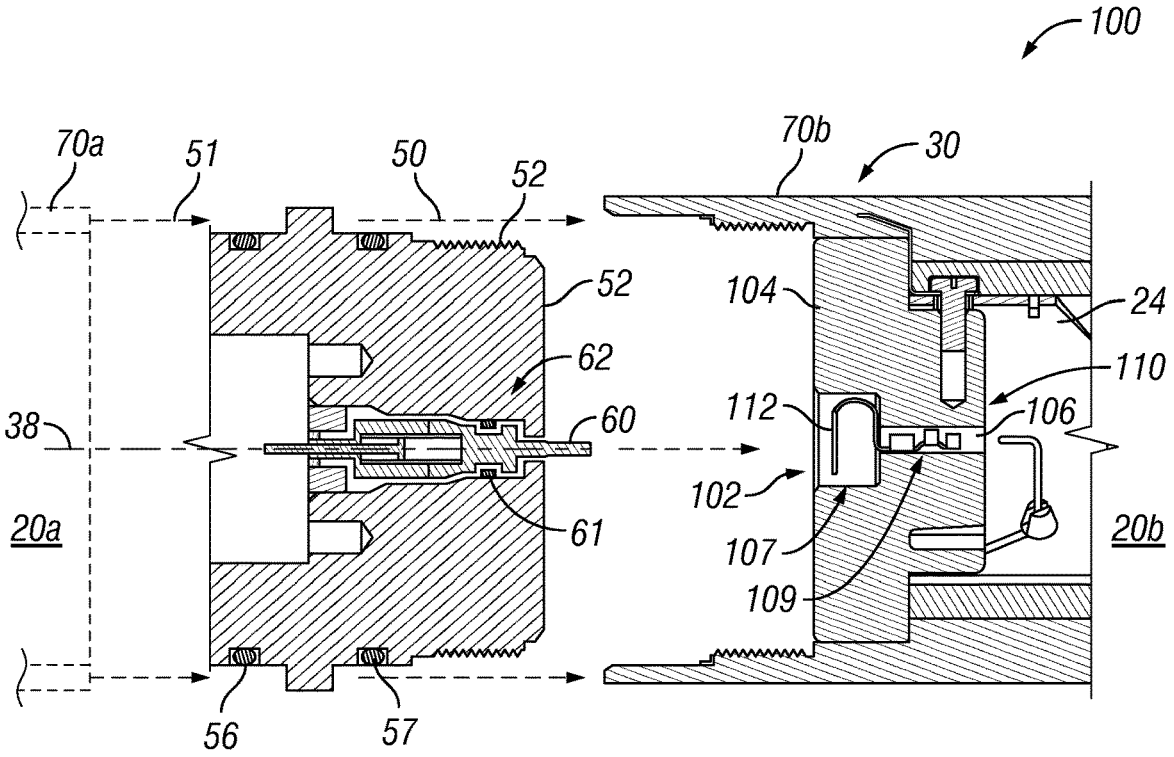
FIG. 2 is a partially exploded side view of an example configuration of the connection for connecting adjacent perforating guns such as in FIG. 1.
Figure 3:
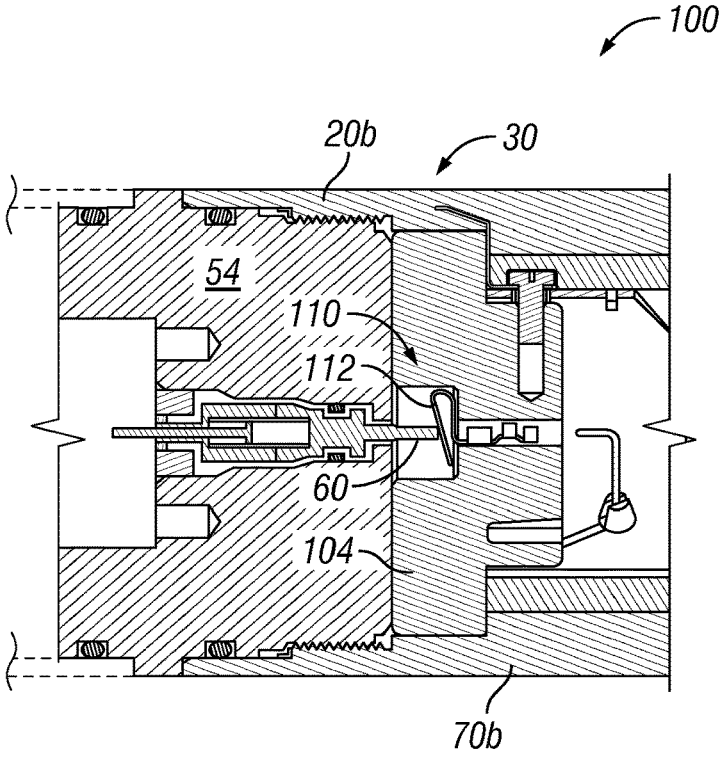
FIG. 3 is a detailed side view of the connection of FIG. 2, with the first perforating gun body moved into connection with the second perforating gun body.

FIG. 2 is a partially exploded side view of the connection 30 according to an example configuration with a connector body 50 aligned for connection with the perforating gun 20*b* on the right (alternately referred to as the second perforating gun) and for subsequent connection with the perforating gun 20*a* on the left (alternately referred to as the first perforating gun). The first perforating gun 20*a* may be a perforating gun that is already connected to a perforating gun string being assembled, and the second perforating gun 20*b* may be a next perforating gun to be connected to the perforating gun string. The connector body 50 may first be connected to the second perforating gun 20*b*, as illustrated in FIGS. 2-3, before bringing the second perforating gun 20*b* into connection with the first perforating gun 20*a*. Corresponding electrical pathway(s) on the second perforating gun 20*b* may be pre-wired or otherwise electrically coupled to the connector 100 on the second perforating gun. Thus, in this example, first physically connecting the second end 52 of the connector body 50 to the connector 100 on the second perforating gun, and then subsequently bringing the first end 51 of the connector body 50 into connection with the first perforating gun 20*a* (as further described below), may establish electrical communication between the first and second perforating guns 20*a*, 20*b*.

The connector body 50 includes complementary features that participate in the connection of the first perforating gun 20*a* with the second perforating gun 20*b*. The connector body 50 in this example is or includes a bulkhead 54, that provides a physical barrier between the internal cavities of adjacent perforating gun bodies while providing electrical pathways therethrough. The bulkhead 54 in this example thus includes at the opposing first and second ends 51, 52 respective seals 56, 57 for sealing with inner diameters of the respective perforating gun bodies 70. The seals 56, 57 may comprise any material and configuration suitable for sealing with contacting surfaces on the bulkhead 54 and perforating gun bodies 70*a*, 70*b*, and are depicted by way of example as a pair of O-rings in this configuration. The bulkhead thereby helps pressure-isolate an interior of one perforating gun body 70*a* from the interior of the adjacent perforating gun body 70*b*, such as to mitigate possible upstream or downstream damage from firing explosive charges as well as to help protect any mechanical elements (e.g., threads) that participate in connecting the perforating gun bodies 70*a*, 70*b*. In addition, the seals 56, 57 keep the internal electrical connections dry from any downhole fluid.

One or more electrical contacts are provided with the connector body 50 to which electrical pathways in the first perforating gun 20*a* are coupled. These electrical contacts in this embodiment include an electrical pin 60 where the signal conductor 38 in the first perforating gun 20*a* terminates. The pin 60 can carry any of a variety of different electrical (e.g., power and/or data) signals, such as to control the energization of one or more detonator and/or to control the firing of one or more charges. In one example, the pin 60 communicates with switches in the perforating gun string via a data signal used to select which detonator to fire, for instance. The pin 60 may alternatively or additionally carry an electrical power signal needed to fire the detonator.

The connector 100 includes another connector member that is referred to as an end alignment or alignment fixture 104. The alignment fixture 104 is coupled directly to the charge tube 24 of the second perforating gun 20*b*. The connector 100 on the second perforating gun further includes an electrical contact structure generally indicated at 110 to which the signal conductor 38 of the second perorating gun 20*b* terminates. Specific example configurations of an electrical contact structure are detailed below in FIGS. 6-8. A free end 107 of the electrical contact structure 110 is disposed within a contact receptacle 102 defined within the alignment fixture 104. An opposing, fixed end 109 of the electrical contact structure 110 is received, secured, and centralized by an alignment bore 106 in the alignment fixture 104. The contact receptacle 102 surrounds, at least partially encapsulates, and thereby protects the free end 107 of the electrical contact structure 110, while still allowing for some movement of the free end 107, such as flexible inward movement of a contact tab 112 that floats within the contact receptacle 102. The electrical contact structure 110 is in a relaxed (unflexed) position in FIG. 2.

The contact receptacle 102 on the alignment fixture 104 of the connector 100 on the second perforating gun is radially, centrally positioned for receiving a mating connector member referred to as a "feedthrough" 62 that axially extends through the bulkhead 54. In this configuration the electrical pin 60 is carried on and extends through the feedthrough 62 with the end of the pin 60 protruding therethrough, although other embodiments may include a pin without a feedthrough. The feedthrough 62 may also provide a pressure barrier via a sealing member such as the O-ring 61, which may cooperate with the seals 56, 57 of the bulkhead to pressure isolate one perforating gun 20*a* from the other perforating gun 20*b*. The feedthrough 62 thereby facilitates electrical contact between the pin 60 on the first perforating gun 20*a* with the electrical contact structure 110 on the second perforating gun 20*b* when the second end 52 of the connector body 50 is connected to the connector 100. More particularly, this feedthrough 62 may be used to convey signals sent from the surface via wireline, and the pin 60 may be used as a pass-through conductor. This electrical connection is further discussed below in relation to FIG. 3.

FIG. 3 is a side view of the connector body 50 having been connected to the connector 100 on the second perforating gun 20*b*. The pin 60 is now in engagement with the contact tab 112 of the electrical contact structure 110. The contact tab 112 has a relatively large contact surface for contact by the pin 60. The electrical contact structure 110 may be formed of a flexible material with a shape that provides compliancy, for elastically deforming in response to engagement of the contact tab by the pin 60. The electrical contact structure 110 flexes so the contact tab 112 moves inwardly relative to its relaxed position of FIG. 2. This elastic deformation of the electrical contact structure 110 causes the contact tab 112 to be biased into engagement with the pin 60.

The connection 30 also supports any rotation of internal components of each perforating gun while maintaining the electrical connection. The pin 60 remains in electrical contact with electrical contact structure 110 during relative rotation therebetween. The large, flat, round surface of the contact tab 112 allows the pin 60 to easily rotate relative to contact tab 112 as needed, such as when the connector body 50 is threaded onto the second perforating gun body 70*b*. This aspect is also useful with rotating internals, such as internal orientating systems that orient charges in a certain direction in relation to an external force such as gravity. In one or more embodiments, the alignment fixture 104 may be supported on a bearing to allow the alignment fixture 104 to rotate based on gravity.

Figure 4:
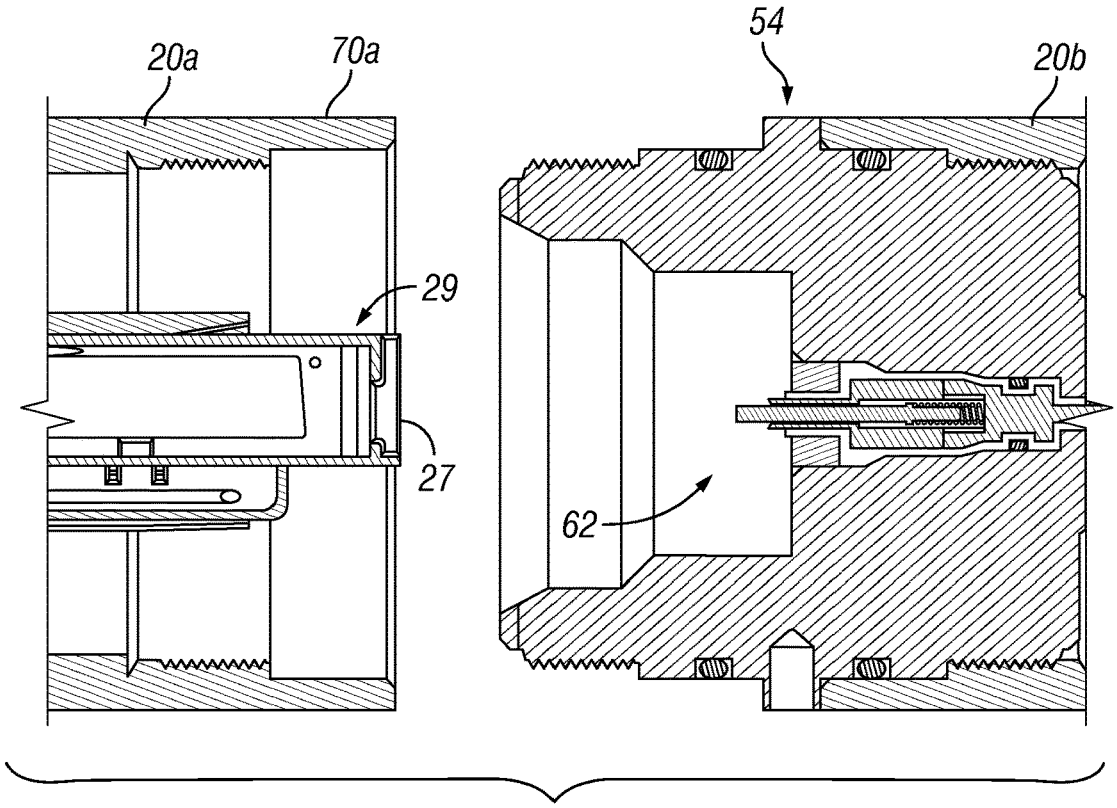
FIG. 4 is a side view of the subassembly of the bulkhead with the second perforating gun, aligned for connection with the first perforating gun.

FIG. 4 is a side view of the subassembly of the bulkhead 54 with the second perforating gun 20*b*, aligned for connection with the first perforating gun 20*a*. The first perforating gun 20*a* may be connected with one or more perforating guns (not shown) in a perforating gun string to the left of the first perforating gun 20*a*. The second perforating gun 20*b* may be the next perforating gun to be connected to the perforating gun string. The sub assembly of the second perforating gun 20*b* and bulkhead 54 may be moved into connection with the first perforating gun 20*a*, positioning the first end 51 of the bulkhead 54 into the first gun body 70*a*. A contact plate 27 on the end of the detonator 29 is positioned for contact with the left side of the feedthrough 62. In other examples, a signal conductor in the first perforating gun 20*a* could be directly hardwired to the feedthrough 62.

Figure 5:
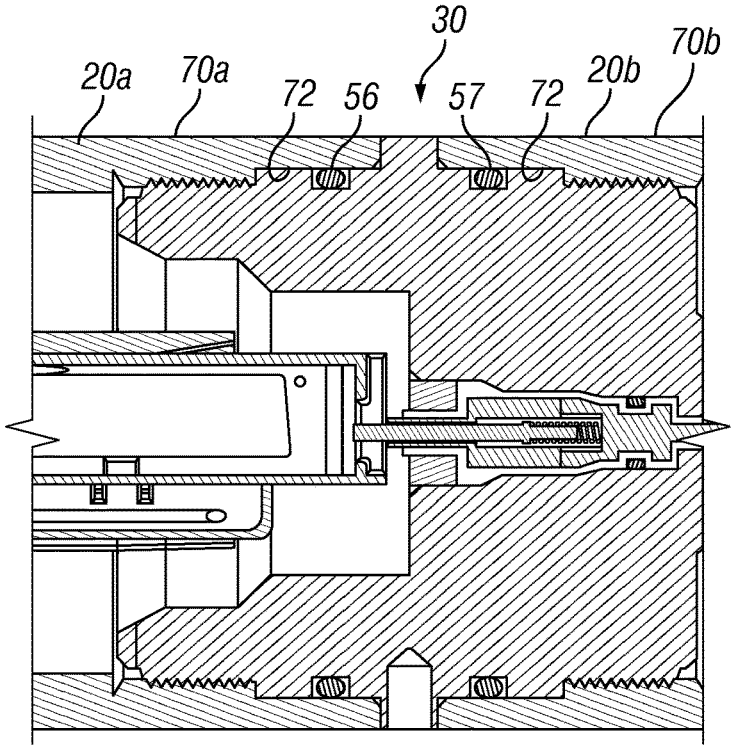
FIG. 5 is an assembled view of the two perforating guns connected end-to-end via the completed connection.

FIG. 5 is an assembled view of the two perforating guns 20*a*, 20*b* connected end-to-end via the completed connection 30. The perforating gun bodies 70*a*, 70*b* may be connected via threaded members such as described above. The seals 56, 57 on the bulkhead are now engaged with the inner diameters 72 of the respective perforating gun bodies 70*a*, 70*b* to pressure seal between the adjacent perforating guns 20*a*, 20*b*. Thus, the first and second perforating gun bodies 70*a*, 70*b* are now physically and electrically connected.

Figure 6:
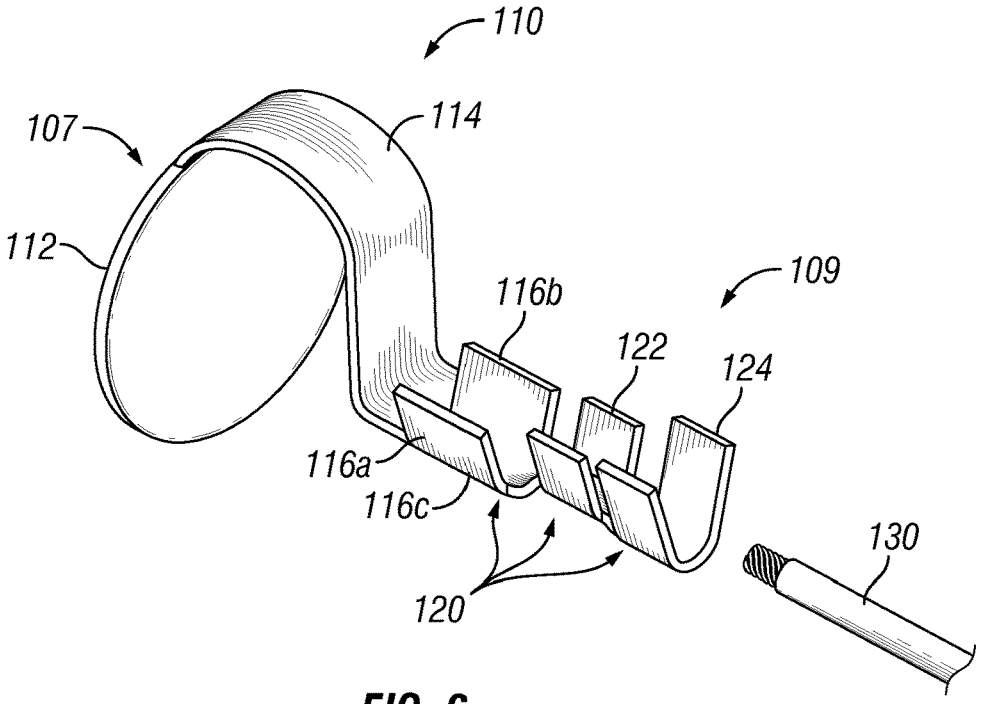
FIG. 6 is a rear-facing, perspective view of the example configuration of the electrical contact structure shown in FIGS. 2 and 3.

FIG. 6 is a rear-facing perspective view of the electrical contact structure 110 according to one example configuration. The electrical contact structure includes the contact tab 112 at the free end 107, a spring element 114 coupled to the contact tab 112, a fixed end 109 coupled to the spring element 114 opposite the contact tab 112, and a wire fastening element 120. The electrical contact structure 110 may also be unitarily formed from a single specimen of electrically conductive material that incorporates the contact tab 112, spring element 114, fixed end 109 with an alignment feature described below, and fastening element 120. Forming the electrical contact structure 110 as a unitary part may reduce the part count, cost, and assembly time, while providing reliability over many cycles of use.

Adjacent to the contact tab 112 is the spring element 114. The spring element 114 in this example is formed into the unitary electrical contact structure and comprises a bend that provides compliancy. In particular, as the contact tab 112 is engaged by the pin, the electrical contact structure 110 flexes primarily in the vicinity of the spring element 114, allowing for deflection of the contact tab 112 within the contact receptacle. The bend of the spring element 114 may be formed with dimensions that provide for a range and upper limit of deflection of the contact tab 112 before the contact tab 112 bottoms out on the portion of the electrical contact structure on the other side of the bend. These dimensions may be selected at the design stage for a particular application to give the desired elastic deflection. The spring element 114 may also account for longitudinal tolerances within the system. It also has the proper stiffness to allow the electrical contact to return to its original shape when adjacent components become disconnected.

The fixed end 109 is used to secure the electrical contact structure 110 to the structure of the connector 100 to radially align electrically contacting elements within the system, such as the contact tab 112 and pin. The fixed end 109 is also unitarily formed with the rest of the electrical contact structure 110.

In this example, an alignment feature includes three edges 116*a*, 116*b*, 116*c* defined by the fixed end 109 that centralize the contact tab 112 within a bore of a separate component that receives it, such as the bore 106 in the alignment fixture 104 of FIG. 2. These three, optionally parallel, non-coplanar edges cooperate to centralize the fixed end 109 within the bore 106, thereby aligning other features disposed along the electrical contact structure (e.g., contact tab 112), with the fixed end 109 being the anchor or reference for the corresponding alignments of those features. Other suitable alignment features may alternatively be used, such as a flat element on an alignment structure configured for being received within a correspondingly shaped (e.g., flat) slot.

The electrical contact structure 110 further includes a fastening element 120 to connect the electrical contact structure 110 to the system both mechanically and electrically. The fastening element 120 could be electrically connected to the alignment fixture 104 (FIG. 3) if it is being used as a conductor. There could also be a separate component in the alignment fixture that is pre-crimped to the wire, in which case the fastening element 120 could snap into or engage that separate component. As shown, the fastening element is a two-point crimp, with one part 122 that crimps onto the conducting part of a wire 130 and a second part 124 that crimps onto the insulation part of the wire 130.

Figure 7:
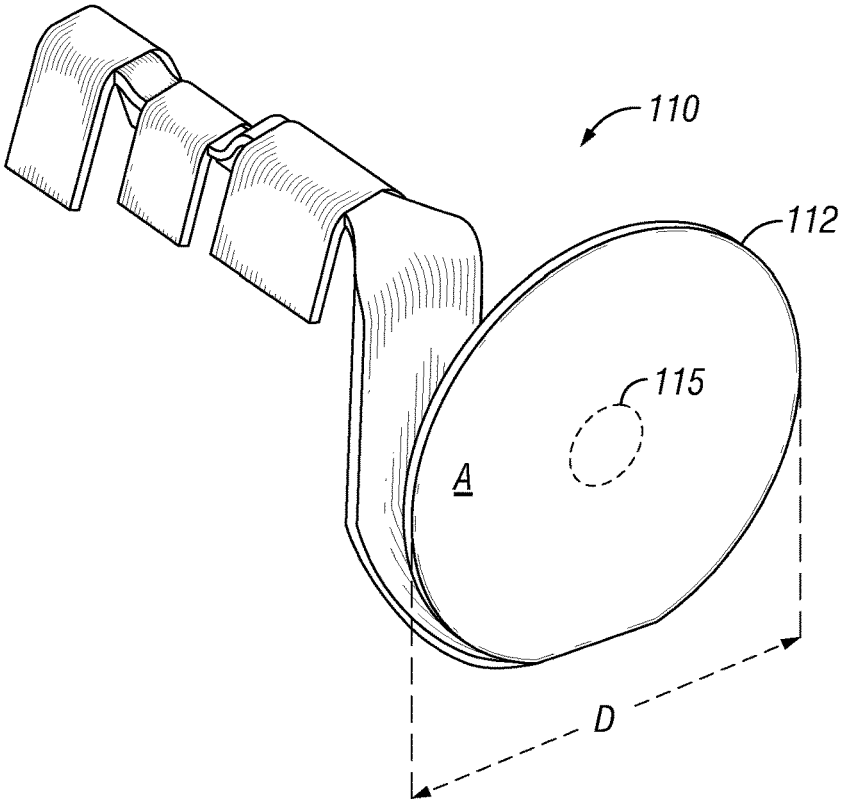
FIG. 7 is another, front-facing perspective view of the electrical contact structure of FIG. 6.

FIG. 7 is a front-facing perspective view of the electrical contact structure 112. The contact tab 112 is optionally circular in this example, which may be well suited to an optionally circular recess that protectively surrounds it (see FIG. 2). Alternatively, the contact tab could be any shape needed so long as the surface is large enough to ensure contact with the pin. As shown, the contact tab 112 is also flat. However, the surface could alternatively be curved (concave or convex) to allow for more surface contact.

The contact surface of the contact tab 112 has a relatively large diameter "D" that substantially fills an inner diameter of the contact receptacle 102 (see FIGS. 2 and 3), but with sufficient room around the contact tab 112 for movement of the contact tab 112 in response to engagement by the pin. The contact tab 112 also has a relatively large contact surface area "A" relative to the comparatively narrow pin 60 (FIGS. 2 and 3). The diameter D may be at least twice a diameter of the pin, and up to five times or more the diameter of the pin. The contact surface area A of the contact tab 112 may be at least four times greater than a contact region 115 between the pin and contact tab 112, which contact region 115 is approximately equal to the cross-sectional area of the pin. In another embodiment, the contact surface area A is up to 25 times greater than the contact region 115.

The contact region 115 is preferably centered within the contact tab 112 as indicated. However, electrical contact may be established at any point on the contact surface area A, in case the pin is not well centered relative to the contact tab 112. Thus, the relatively large size of the contact tab 112 helps to establish and maintain reliable contact with the pin. The large contact tab 112 may also allow for larger dimensional tolerances, allowing parts that are not perfectly concentric or a pin that is not perfectly aligned with the contact tab to still be utilized in the assembly. This likewise reduces machining cost, since larger tolerances would be acceptable and less parts potentially would be scrapped from exceeding tight tolerances. This aspect is also helpful for systems with rotating internals, ensuring the pin may remain in contact with the contact tab during relative rotation. This is also especially helpful in parts like perforating guns, which may experience high stress and temperatures due to explosive charges that can cause parts to deform slightly or otherwise lose their original as-manufactured dimensional tolerances.

Figure 8:
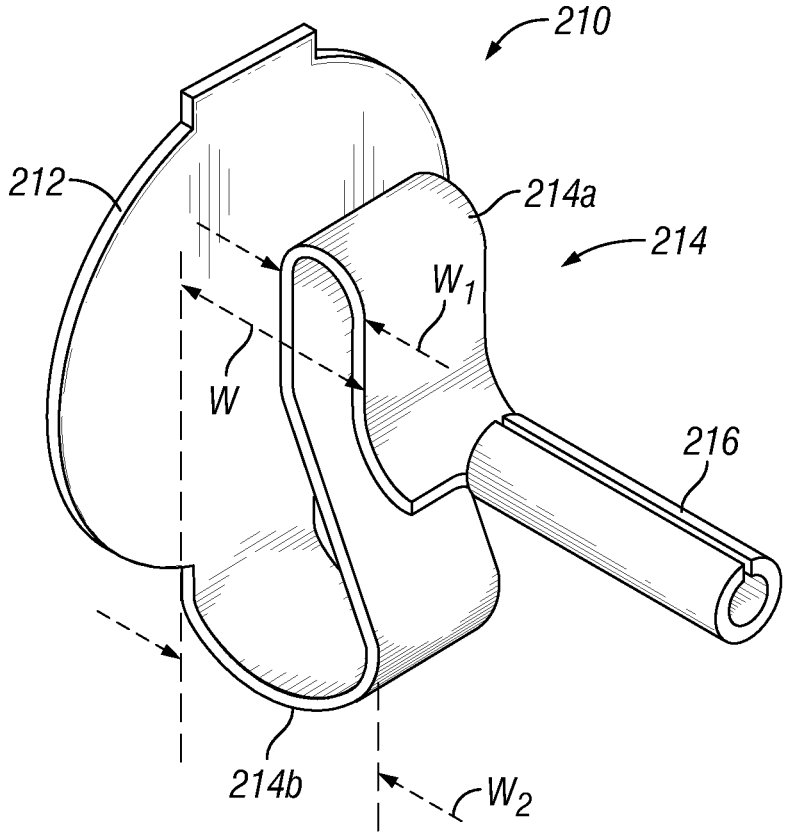
FIG. 8 is an enlarged, perspective view of another example configuration of an electrical contact structure.

FIG. 8 is a perspective view of another electrical contact structure 210 according to an alternative configuration. This electrical contact structure 210 includes a circular contact tab 212 supported on a non-coiled spring element 214 comprising two bends 214*a*, 214*b*. The two bends 214*a*, 214*b* have respective widths w1 and w2. The two bends optionally overlap in an axial direction, such that the sum of their widths (w1+w2) is greater than the overall width "W" of the spring element 214. These overlapping bends help increase compliancy of the electrical contact structure even with an overall dimensional constraint of width W.

This embodiment of the electrical contact structure 212 also has a fixed end 216 used for both securing and centering the electrical contact structure 212 within the connector 100. The fixed end 216 comprises a tubular post having a generally cylindrical outer shape, which may be formed from the parent material of the electrical contact structure 216. The fixed end can be received in a complementary connector bore, such as in the alignment fixture of the connector on the second perforating gun. The position of the fixed end 216 generally aligns the contact tab 212 for engagement by the pin. The fixed end 216 can also receive a wire and be crimped or soldered about a portion of the wire and/or the wire insulation.

Accordingly, the present disclosure provides various apparatus, methods, and tools for securing a component such as a sealing element to a tubular mandrel of a downhole tool. These may include any of the various features disclosed herein, including one or more of the following statements.

Statement 1. A perforating gun connection, comprising: a connector body having a first end positionable within a first perforating gun and an opposing second end positionable within a second perforating gun; a pin carried on the connector body, the pin extending through to the second end of the connector body for electrical connection with the second perforating gun; and an electrical contact structure coupled to a signal conductor of the second perforating gun, the electrical contact structure including a free end with a contact tab aligned for engagement by the pin upon positioning the second end of the connector body within the second perforating gun and a spring element coupled with the contact tab for elastically deforming in response to engagement by the pin.

Statement 2. The perforating gun connection of Statement 1, further comprising: an alignment fixture on the second perforating gun defining a contact receptacle, wherein the contact tab is movably disposed within the contact receptacle for engagement by the pin upon positioning the second end of the connector body in the second perforating gun.

Statement 3. The perforating gun connection of Statement 2, further comprising: a feedthrough on the connector body axially extending toward the contact receptacle on the alignment fixture, with the pin extending therethrough.

Statement 4. The perforating gun connection of Statement 2 or 3, wherein the connector body comprises a bulkhead with one or more sealing members disposed on the bulkhead for pressure-isolating the first perforating gun from the second perforating gun.

Statement 5. The perforating gun connection of any of Statements 2 to 4, wherein the electrical contact structure further comprises a fixed end coupled with the spring element and secured within a bore of the alignment fixture to centralize the contact tab for engagement by the pin.

Statement 6. The perforating gun connection of Statement 5, wherein the fixed end of the electrical contact structure comprises an alignment feature comprising three non-coplanar edges that cooperate to centralize the contact tab.

Statement 7. The perforating gun connection of Statement 5 or 6, wherein the fixed end of the electrical contact structure comprises an alignment feature including a tubular post having a generally cylindrical outer shape.

Statement 8. The perforating gun connection of any of Statements 1 to 7, wherein the spring element of the electrical contact structure comprises at least two bends unitarily formed with the electrical contact structure.

Statement 9. The perforating gun connection of Statement 8, wherein the at least two bends of the spring element comprise a first bend having a first width and a second bend having a second width, wherein the first bend overlaps the second bend such that an overall width of the spring element is less than a sum of the first and second widths.

Statement 10. The perforating gun connection of any of Statements 1 to 9, wherein a contact surface area of the contact tab is at least four times a contact region between the contact tab and the pin.

Statement 11. The perforating gun connection of any of Statements 1 to 10, wherein a contact surface area of the contact tab is at least twenty-five times a contact region between the contact tab and the pin.

Statement 12. The perforating gun connection of any of Statements 1 to 11, wherein the contact tab is circular and flat.

Statement 13. The perforating gun connection of any of Statements 1 to 12, wherein the contact tab is circular and is concave or convex.

Statement 14. An apparatus, comprising: a connector body positionable within a perforating gun; a pin carried on the connector body; and an electrical contact structure coupled to a signal conductor of the perforating gun, the electrical contact structure including a free end with a contact tab aligned for engagement by the pin upon positioning the connector body within the perforating gun, a spring element coupled with the contact tab for elastically deforming in response to engagement by the pin, and a fixed end unitarily formed with the spring element to centralize the contact tab for engagement by the pin.

Statement 15. The apparatus of Statement 14, further comprising: an alignment fixture on the perforating gun defining a contact receptacle, wherein the contact tab is movably disposed within the contact receptacle for engagement by the pin upon connecting the connector body to the perforating gun; and a feedthrough on the connector body axially extending toward the contact receptacle, with the pin extending through the feedthrough.

Statement 16. A method of perforating a well, comprising: connecting a string of perforating guns end to end, including positioning a first end of a connector body within a first perforating gun, with a pin carried on the connector body coupled to a signal conductor of the first perforating gun, positioning an opposing second end of the connector body within an adjacent second perforating gun to engage the pin with an electrical contact structure of the second perforating gun, the electrical contact structure coupled to a signal conductor of the second perforating gun, the electrical contact structure including a free end with a contact tab aligned for engagement by the pin upon positioning the second end of the connector body within the second perforating gun and a spring element unitarily formed with the contact tab for elastically deforming in response to engagement by the pin; suspending the string of perforating guns on a conveyance into a well along a section to be perforated; transmitting a signal down the conveyance to the first perforating gun and through the pin to the electrical contact structure of the second perforating gun to select which of the perforating guns to fire; and firing one or more shaped charges in each of the selected perforating guns in response to the signal.

Statement 17. The method of Statement 16, further comprising engaging the pin with the electrical contact structure anywhere along a contact surface area of the contact tab, wherein the contact surface area of the contact tab is at least four times a contact surface area of a contact region between the pin and the contact tab.

Statement 18. The method of Statement 17, wherein a contact surface area of the contact tab is at least twenty-five times a contact region between the contact tab and the pin.

19. The method of any of Statements 16 to 18, further comprising: aligning the electrical contact structure with an alignment feature comprising three non-coplanar edges that cooperate to centralize the contact tab.

Statement 20. The method of any of Statements 16 to 19, further comprising: compressing at least two bends of a non-coiled spring element in response to engaging the electrical contact structure with the pin; and biasing the contact tab into electrical engagement with the pin in response to the compressing of the at least two bends.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A perforating gun connection, comprising:

a connector body, comprising:

a first end positionable within a first perforating gun; and a second end, opposite the first end, positionable within a second perforating gun;

a pin carried on the connector body, wherein the pin extends through the second end, and wherein the pin is configured to make electrical contact with the second perforating gun; and an electrical contact structure coupled to a signal conductor of the second perforating gun, wherein the electrical contact structure comprises:

a free end with a contact tab which is aligned for engagement with the pin upon positioning the second end within the second perforating gun; and a spring element, coupled with the contact tab, which elastically deforms in response to the contact tab engaging with the pin.

2. The perforating gun connection of claim 1, further comprising:

an alignment fixture on the second perforating gun defining a contact receptacle, wherein the contact tab is movably disposed within the contact receptacle for engagement by the pin upon positioning the second end of the connector body in the second perforating gun.

3. The perforating gun connection of claim 2, further comprising:

a feedthrough on the connector body axially extending toward the contact receptacle on the alignment fixture, with the pin extending therethrough.

4. The perforating gun connection of claim 2, wherein the electrical contact structure further comprises a fixed end coupled with the spring element and secured within a bore of the alignment fixture to centralize the contact tab for engagement by the pin.

5. The perforating gun connection of claim 4, wherein the fixed end of the electrical contact structure comprises an alignment feature comprising three non-coplanar edges that cooperate to centralize the contact tab.

6. The perforating gun connection of claim 4, wherein the fixed end of the electrical contact structure comprises an alignment feature including a tubular post having a generally cylindrical outer shape.

7. The perforating gun connection of claim 1, wherein the connector body comprises a bulkhead with one or more sealing members disposed on the bulkhead for pressure-isolating the first perforating gun from the second perforating gun.

8. The perforating gun connection of claim 1, wherein the spring element of the electrical contact structure comprises at least two bends unitarily formed with the electrical contact structure.

9. The perforating gun connection of claim 8, wherein the at least two bends of the spring element comprise a first bend having a first width and a second bend having a second width, wherein the first bend overlaps the second bend such that an overall width of the spring element is less than a sum of the first and second widths.

10. The perforating gun connection of claim 1, wherein a contact surface area of the contact tab is at least four times a contact region between the contact tab and the pin.

11. The perforating gun connection of claim 1, wherein a contact surface area of the contact tab is at least twenty-five times a contact region between the contact tab and the pin.

12. The perforating gun connection of claim 1, wherein the contact tab is circular and flat.

13. The perforating gun connection of claim 1, wherein the contact tab is circular and is concave or convex.

14. An apparatus, comprising:

a connector body positionable within a perforating gun;

a pin carried on the connector body; and an electrical contact structure coupled to a signal conductor of the perforating gun, wherein the electrical contact structure comprises:

a free end with a contact tab which is aligned for engagement with the pin upon positioning the connector body within the perforating gun, a spring element coupled with the contact tab, which elastically deforms in response to the contact tab engaging with the pin; and a fixed end unitarily formed with the spring element to centralize the contact tab for engagement by the pin.

15. The apparatus of claim 14, further comprising:

an alignment fixture on the perforating gun defining a contact receptacle, wherein the contact tab is movably disposed within the contact receptacle for engagement by the pin upon connecting the connector body to the perforating gun; and a feedthrough on the connector body axially extending toward the contact receptacle, with the pin extending through the feedthrough.

16. The apparatus of claim 15, wherein the fixed end is secured within a bore of the alignment fixture.

17. The apparatus of claim 14, wherein the connector body comprises a bulkhead with one or more sealing members disposed on the bulkhead for pressure-isolating the perforating gun.

18. The apparatus of claim 14, wherein the fixed end of the electrical contact structure comprises an alignment feature comprising either three non-coplanar edges that cooperate to centralize the contact tab or a tubular post having a generally cylindrical outer shape.

19. The apparatus of claim 14, wherein the spring element of the electrical contact structure comprises at least two bends unitarily formed with the electrical contact structure.

20. The apparatus of claim 19, wherein the at least two bends of the spring element comprise a first bend having a first width and a second bend having a second width, wherein the first bend overlaps the second bend such that an overall width of the spring element is less than a sum of the first and second widths.

* * * * *